US006397477B1

(12) United States Patent
Collins

(10) Patent No.: US 6,397,477 B1
(45) Date of Patent: Jun. 4, 2002

(54) SPRING-ASSISTED FOLDING KNIFE

(76) Inventor: Walter W. Collins, P.O. Box 100, North, SC (US) 29112

( * ) Notice: Subject to any disclaimer, the term of this patent is extended or adjusted under 35 U.S.C. 154(b) by 0 days.

(21) Appl. No.: 09/619,451

(22) Filed: Jul. 19, 2000

(51) Int. Cl.[7] ..... B26B 1/04
(52) U.S. Cl. ..... 30/161; 30/155
(58) Field of Search ..... 30/151, 155, 158, 30/159, 160, 161

(56) References Cited

U.S. PATENT DOCUMENTS

| | | | | | |
|---|---|---|---|---|---|
| 273,858 | A | | 3/1883 | Korn | 30/159 |
| 698,080 | A | | 4/1902 | Treas | 30/159 |
| 1,065,863 | A | | 6/1913 | Carter | 30/155 |
| 1,603,914 | A | | 10/1926 | Hermann | 30/159 |
| 2,407,897 | A | | 9/1946 | Newman | 30/159 |
| 2,601,999 | A | | 7/1952 | Sly | 403/96 |
| 4,190,953 | A | | 3/1980 | Naifeh | 30/155 |
| 4,268,960 | A | * | 5/1981 | Reinschreiber | 30/161 |
| 4,451,982 | A | | 6/1984 | Collins | 30/161 |
| 4,535,539 | A | | 8/1985 | Friedman et al. | 30/161 |
| 4,570,341 | A | * | 2/1986 | Konneker | 30/161 |
| 4,893,409 | A | | 1/1990 | Poehlmann | 30/161 |
| 4,897,922 | A | | 2/1990 | Brooker | 30/166 |
| 5,054,200 | A | | 10/1991 | Davis, Jr. | 30/152 |
| 5,093,995 | A | | 3/1992 | Jan | 30/161 |
| 5,327,651 | A | | 7/1994 | Favreau | 30/161 |
| 5,400,509 | A | * | 3/1995 | Collins | 30/161 |
| 5,815,927 | A | | 10/1998 | Collins | 30/161 |
| 5,915,792 | A | * | 6/1999 | Sakurai | 30/161 |
| 5,964,035 | A | | 10/1999 | Poehlmann | 30/161 |
| 6,079,106 | A | * | 6/2000 | Vallotton | 30/161 |

FOREIGN PATENT DOCUMENTS

| | | | |
|---|---|---|---|
| DE | 28765 | 1/1884 | 30/159 |
| FR | 435488 | 10/1911 | 30/159 |

* cited by examiner

*Primary Examiner*—Hwei-Siu Payer
(74) *Attorney, Agent, or Firm*—Leatherwood Walker Todd & Mann, P.C.

(57) ABSTRACT

Spring-assisted folding knife designs having a coil spring, cable, and spool arrangement for pivoting a blade from a retracted position to an extended position. Activation of the spring system can be accomplished a pushbutton mounted on the side of the knife's handle, or through depression of a locking lever carried on the back side of the handle. Once moved to the extended position, the blade is automatically locked in that position through the pushbutton mechanism in one embodiment, or, in the other embodiment, through a liner lock.

18 Claims, 8 Drawing Sheets

SPRING-ASSISTED FOLDING KNIFE

BACKGROUND OF THE INVENTION

This invention relates generally to a folding knife having a spring-assisted blade opening mechanism.

The present invention includes a folding knife comprising a handle; a blade pivotally connected to the handle for movement between an extended position extending outwardly from the handle and a retracted position adjacent the handle; a spool connected to the blade for movement with the blade, the spool defining a plurality of attachment openings; and a spring connected to at least one of the attachment openings of the spool and to the handle, the spring urging the blade towards the extended position.

Folding knives are popular due to their compact size and portability. However, a potential drawback of certain folding knives is that they require two hands for use. One hand is required for holding the handle portion of the blade, while the other hand is necessary to withdraw the blade from its retracted position within the handle and move the blade to the extended, operable position.

Accordingly, it is desirable to have a folding knife wherein the blade can be opened using one hand. One such folding knife design is disclosed in Applicant's U.S. Pat. No. 5,815,927, issued Oct. 6, 1998, and entitled "Folding Knife With Actuatable Safety Locking Mechanism." That design allows the user to extract blade from its retracted position within the handle by the user's engaging and pulling on ridges defined in a rear portion of the blade. A plunger mechanism having a coil spring facilitates opening of the blade, but the user is still required to pull on the ridges in order to move the blade through a selected range of motion and for the spring to assist the blade to move it to the extended position.

Providing a folding knife design wherein the blade may be opened using only one hand produces obvious advantages. The user is allowed to use one hand for holding, pulling, or pushing on the object to be cut while at the same time being able to withdraw the folding knife from his or her pocket, toolbox, or some other compartment and moving the blade to an extended, usable position. Another advantage is for disabled persons who may have only one arm or one functioning hand. Further, law enforcement and military personnel may find a folding knife which may be operated with one hand useful in performing their duties.

Numerous folding knife designs have been patented. For example, U.S. Pat. No. 273,858, issued to Korn, discloses a folding knife having a leaf-type spring for moving a blade to an extended position. U.S. Pat. No. 1,603,914, issued to Hermann, discloses a folding knife having a coil spring connected to a metal tape, which pulls the blade to a retracted position. U.S. Pat. No. 2,601,999, issued to Sly, discloses a foldable gaff hook having a similar opening mechanism. U.S. Pat. No. 2,407,897, issued to Newman also discloses a spring for pivoting blade open upon actuation of a locking lever. U.S. Pat. No. 698,080, issued to Treas, also discloses use of an actuating spring for pivoting a blade to an open position.

U.S. Pat. No. 4,535,539, issued to Friedman, et al, and U.S. Pat. No. 5,093,995, issued to Jan, disclose button release mechanisms for folding knives.

U.S. Pat. Nos. 4,893,409 and 5,964,035, issued Poehlmann, disclose folding knives having adjustment screws for adjusting the fit of the blade in the extended position. U.S. Pat. No. 1,065,863, issued to Carter, also discloses use of set, or an adjustment, screw.

SUMMARY OF THE INVENTION

It is, therefore, the principal object of this invention to provide a folding knife which can be opened by the user using only one hand.

Another object of the present invention is to provide a folding knife which opens automatically upon actuation of a release mechanism.

Still another object of the present invention is to provide a folding knife whereupon movement of the blade to the extended position causes the blade to be automatically locked in the extended position.

A still further object of the present invention is to provide a folding knife having a release member located on the back of the handle, such that depression thereof causes the blade to automatically move to the extended position.

A further object of the present invention is to provide a method of assembling a folding knife.

Another object of the present invention is to provide a method of extending a blade of a folding knife.

BRIEF DESCRIPTION OF THE DRAWINGS

The foregoing, as well as other objects of the present invention, will be further apparent from the following detailed description of the preferred embodiment of the invention, when taken together with the accompanying specification and the drawings, in which.

DESCRIPTION OF THE PREFERRED EMBODIMENT

Figure 1:
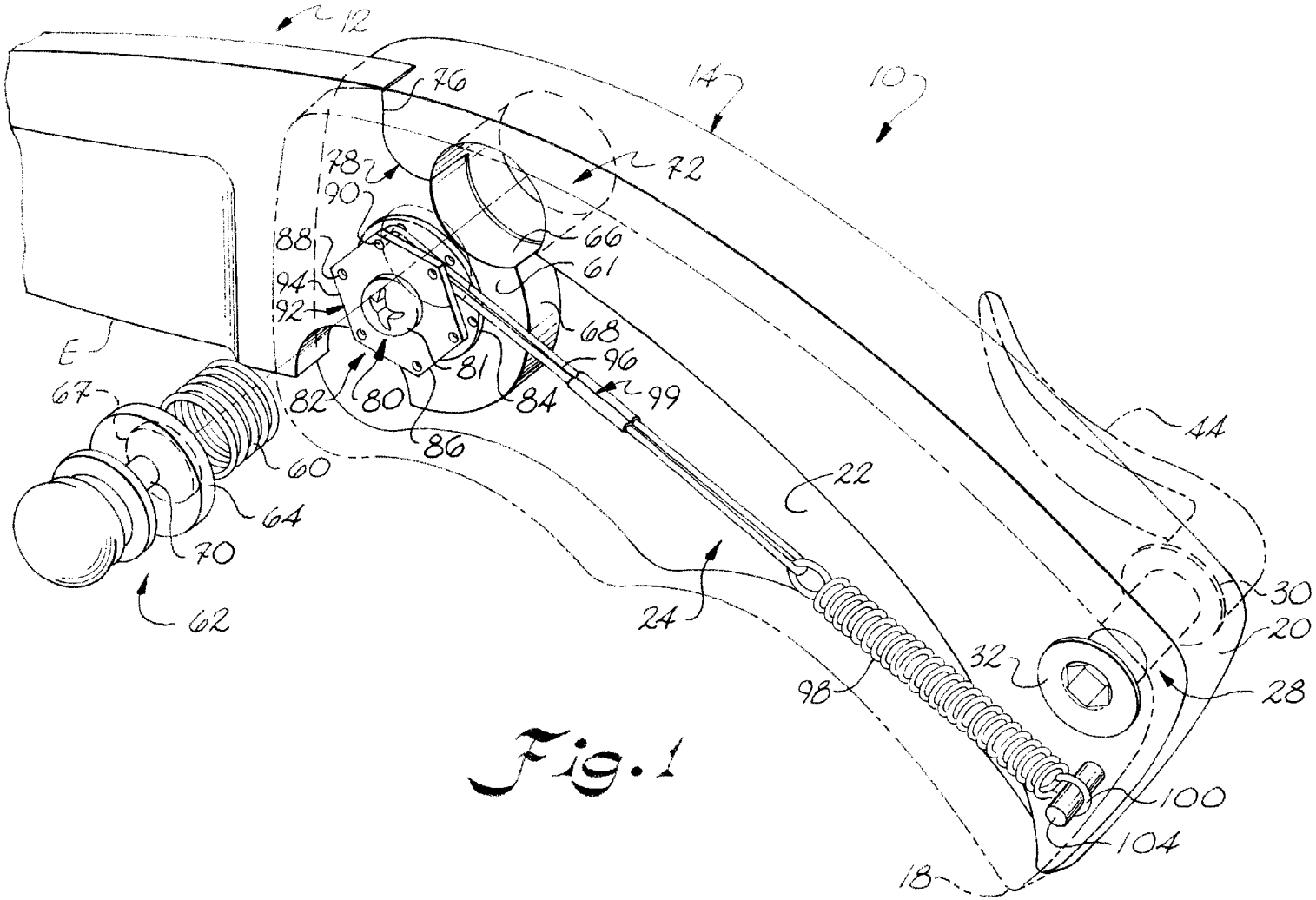
FIG. 1 is a partial perspective and exploded view of a folding knife constructed in accordance with the present invention, wherein the blade is shown in an extended position.
Figure 2:
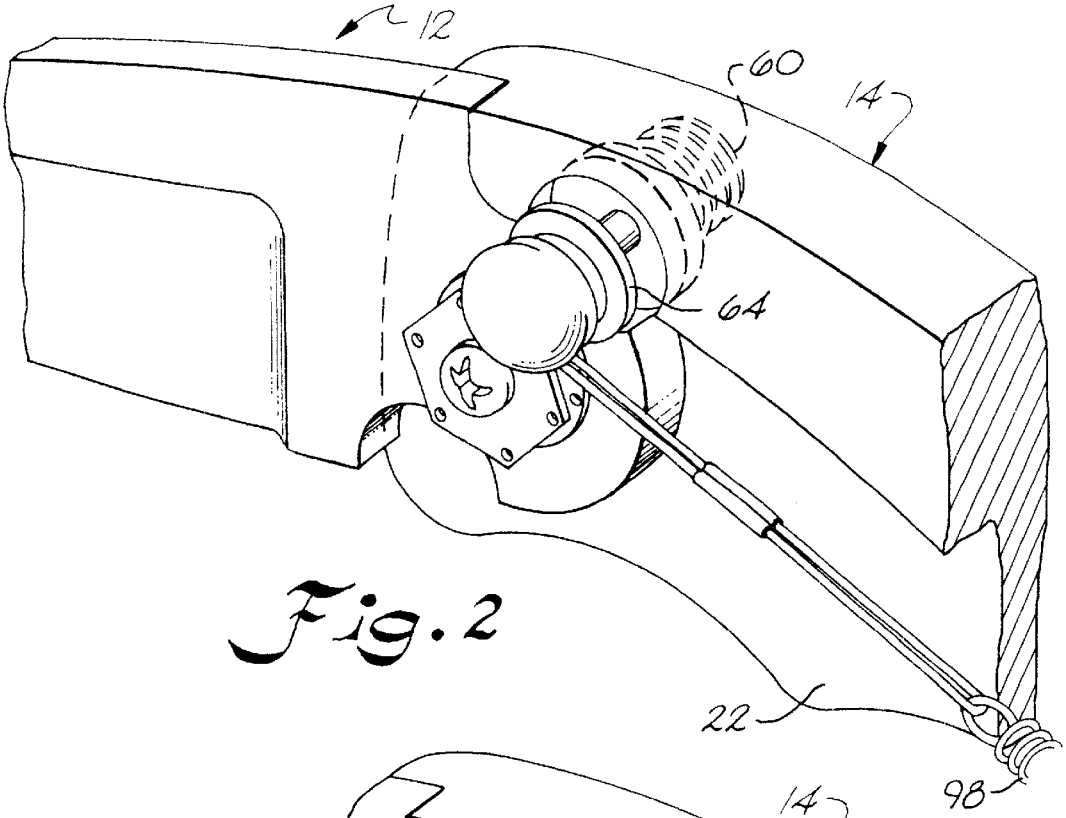
FIG. 2 is a partial perspective view of the knife illustrated in FIG. 1, with the blade in an extended position.

The accompanying drawings and the description which follows set forth this invention in its preferred embodiment. However, it is contemplated that persons generally familiar with folding knives will be able to apply the novel characteristics of the structures illustrated and described herein in other contexts by modification of certain details. Accordingly, the drawings and description are not to be taken as restrictive on the scope of this invention, but are to be understood as broad and general teachings.

Referring now to the drawings in detail, wherein like reference characters represent like elements or features throughout the various views, the folding knife of the present invention is indicated generally in the figures by reference character 10.

Figure 4:
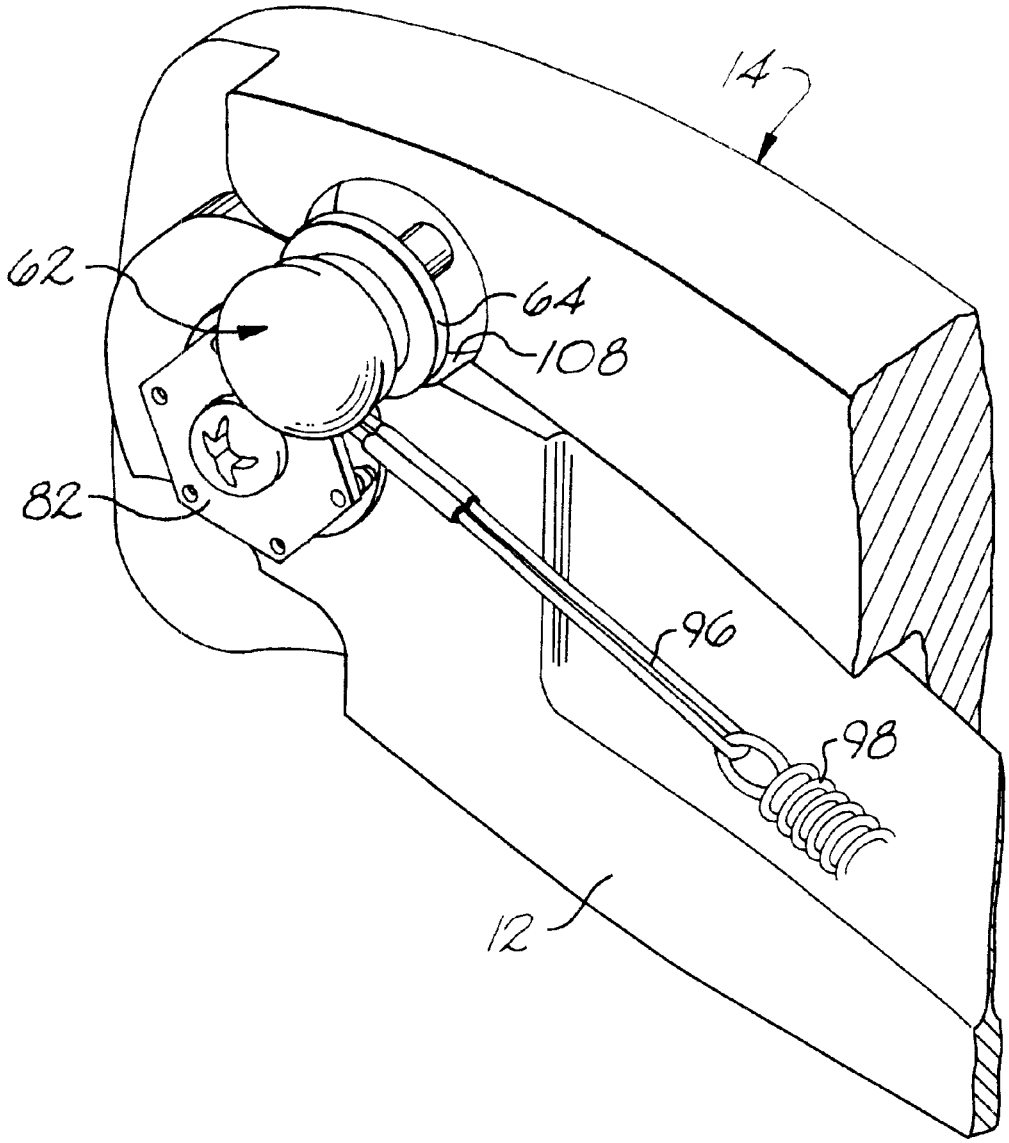
FIG. 4 is a partial perspective view of the knife illustrated in FIG. 1, wherein the blade is illustrated in a retracted position.

Turning to FIG. 1, a folding knife 10 is shown having a blade, generally 12, in an extended position. Blade 12 includes a cutting edge E. Handle, generally 14, includes first and second portions, or sides, generally 18, 20. Right side 20 of handle 14 includes a recessed portion 22 which, together with left side portion 18, serves to define a blade cavity 24 for seat of blade 12, when blade 12 is in a retracted position, such as shown in FIG. 4.

Figure 10:
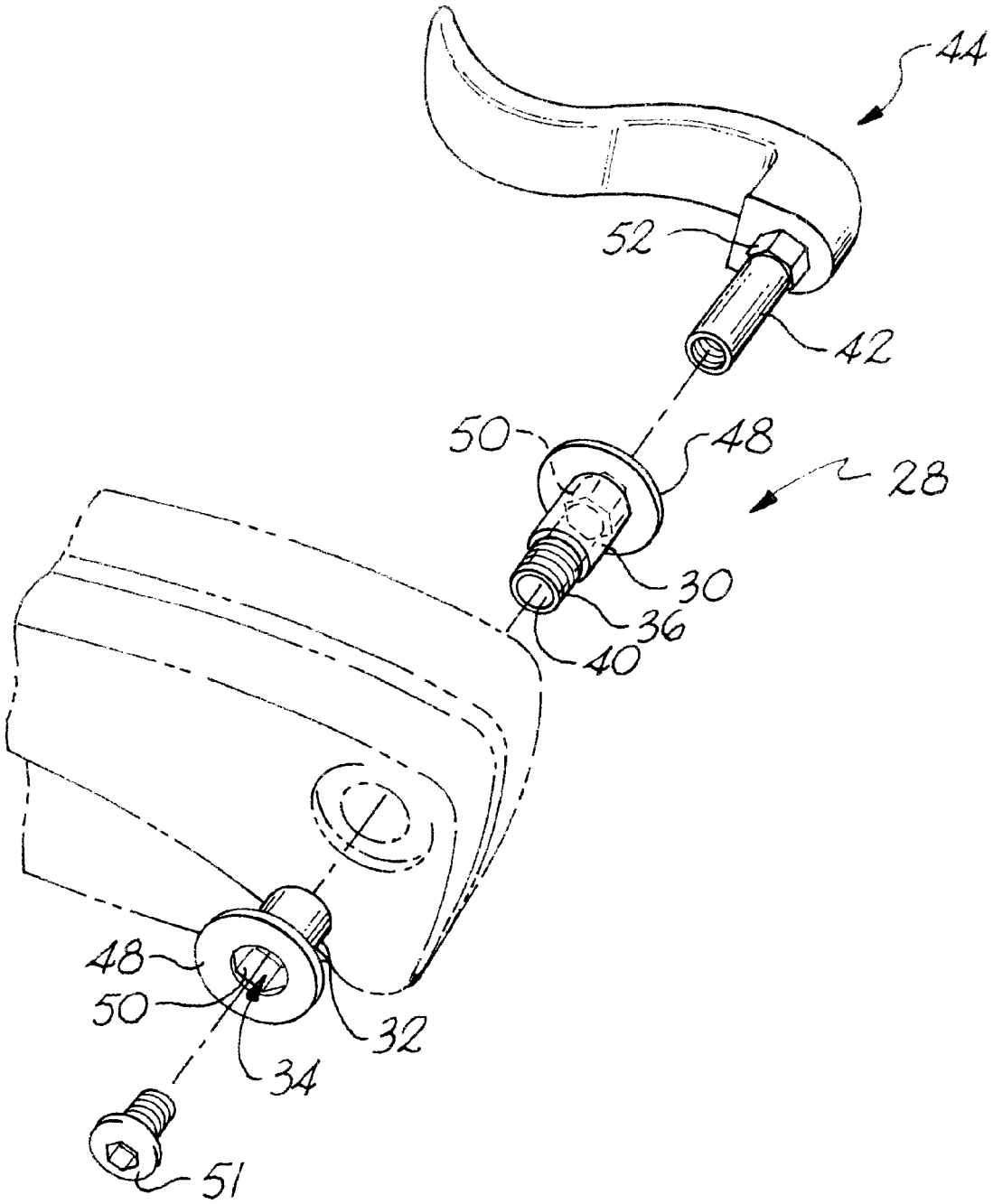
FIG. 10 is a partial exploded view of the connector used in assembly of a knife constructed in accordance with the present invention and a clip for use in connection with such knife.

A fastener, or connector, generally 28, is used to attach the rearward portion of sides 18 and 20 together. As more clearly shown in FIG. 10, connector 28 includes a male portion 30 and a female portion 32. Female portion 32 includes a threaded channel 34 for receipt of a threaded sleeve 36 of male portion 30. Sleeve 36 defines a cylindrical passage 40 for receipt of a projection 42 of a clip, generally 44. Clip 44 is attached to handle 14 for use in retaining the knife to the user's pocket, backpack, boot, etc. Each of portions 30, 32 include a head 48, and each head includes an interior drive profile 50 for use with a standard driver such as an Allen wrench, or Phillips, blade, Torx, etc. driver. A screw 51 attaches clip 44 to handle 14. As shown in FIG. 10, profile 50 is of hexagonal shape and is mateable with a cooperating profile 52, also of hexagonal shape on clip 44. This feature will be discussed in more detail below.

Figure 3:
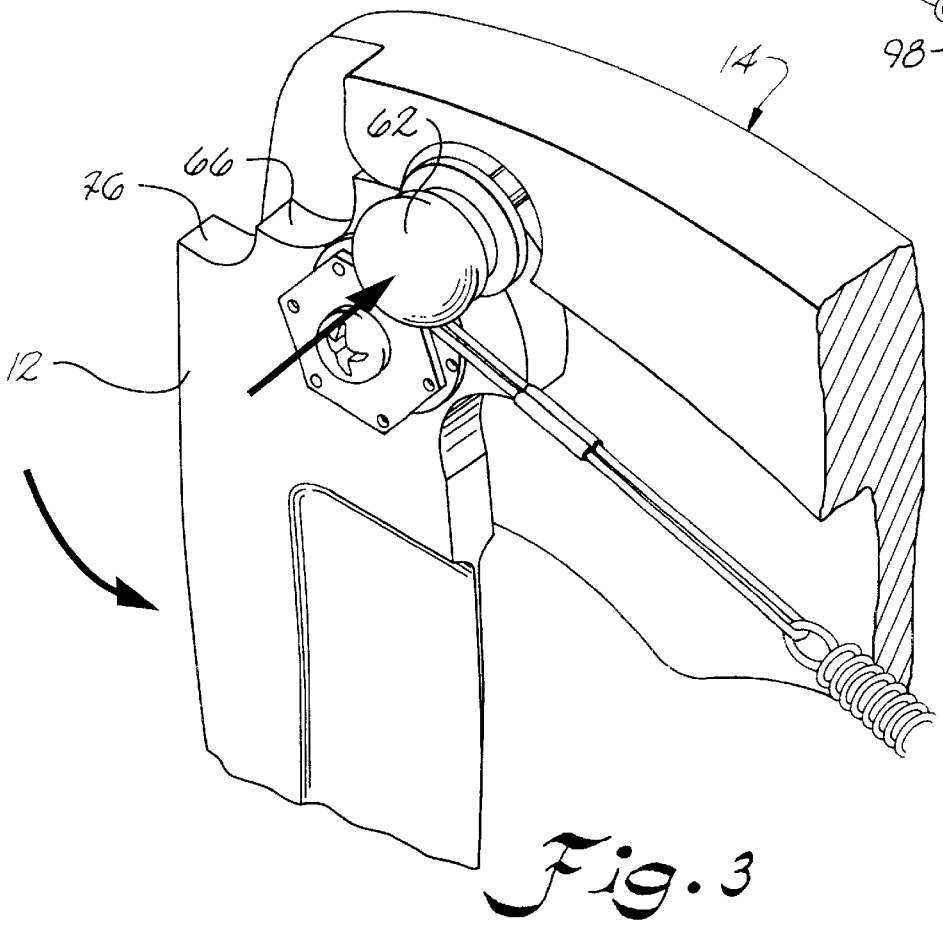
FIG. 3 is a partial perspective view of the knife shown in FIG. 1, with the blade in an intermediate position between the extended and retracted positions.
Figure 9:
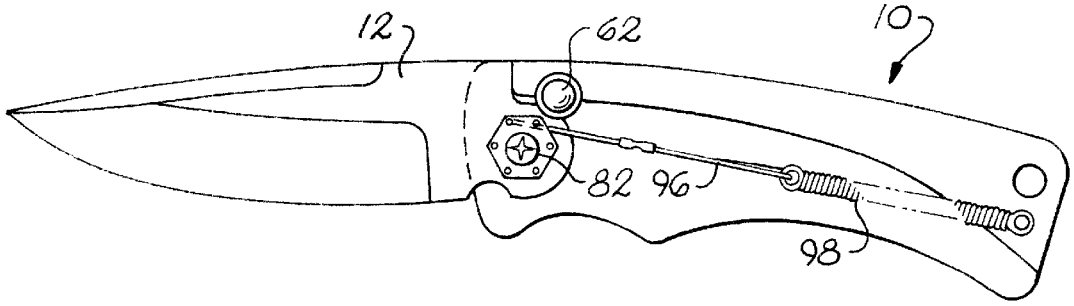
FIG. 9 is a side elevational view, with parts cut away, of the knife illustrated in FIG. 1.

Returning to FIGS. 1 and 9, blade 12 is locked in its extended position automatically once it arrives at such position by virtue of a coil spring 60, urging a push button member, generally 62, upwardly such that a locking disk 64 of push button 62 registers with an extended position scallop 66 defined in blade 12. One end of spring 60 is held to push button 62 by a boss 67 on the bottom of pushbutton 62. Blade 12 remains locked in this extended position until pushbutton 12 is depressed sufficiently, against the force of spring 60, so that locking disk 64 no longer registers with scallop 66, and the radiused end 68 of tang 61 of blade 12 may clear a bypass post 70 of pushbutton 62 as blade 12 is pivoted rearwardly as shown in FIG. 3 towards blade cavity 24. Pushbutton 62 moves within a pushbutton passage, generally 72, as it is depressed by the user, and moved outwardly by spring 60.

Blade 12 includes a stop profile 76 which engages with the stop 78 defined in handle portion 20, and blade 12 is connected to handle 14 by means of a screw post arrangement, generally 80. The screw post arrangement 80 includes a first screw portion 81, which engages with left side 18 of handle 14 and a second screw portion (not shown) which engages with side 20 of handle 14. One of the screw portions is a male configuration and the other a female to allow connection together, in a manner not unlike connector 28. Blade 12 rotates with respect to the screw post arrangement 80.

Fixedly connected to blade 12 is a spool member, generally 82. Spool member preferably includes a threaded portion received in a corresponding threaded opening of blade 12, neither being shown. It is to be understood, however, that spool 82 can be connected to blade 12 by other means such as a press-fit arrangement, epoxy, soldering, welding, etc. Spool 82 includes a bottom flange portion 84 and an upper flange portion 86, each flange portion 84, 86 having readily disposed openings 88 for receipt of a pin 90. Upper flange 86 also includes a drive profile 92, which could be hexagonal in shape, shown in FIG. 1, having six sides 94.

Pin 90 is interconnected between openings 88 and serves as a post for receiving a loop of cable 96, which connects spool member 82 to a coil spring, generally 98. Cable 96 also forms a loop at a receiver eyelet of spring 98, and cable 96 includes a clamp such as a metal crimped member, generally 99, for forming the loops in cable 96. The other end of coil spring includes an eyelet 100 attached to a post 104, which is fixedly connected to side 20 of handle 14.

FIG. 4 illustrates blade 12 in a retracted position, and locking disk 64 of pushbutton 62 is in registration with a retracted position scallop 108 defined in blade 12. In the retracted position, it can be seen that cable 96 is wound about spool 82, between flanges 84 and 86, around the major portions of the periphery of spool 82. To move blade 12 to an extended position, pushbutton 62 is depressed such that locking disk 64 no longer registers with scallop portion 108. This causes blade 12 to immediately pivot outwardly to the extended position by virtue of the tension spring force applied by coil spring 98, acting through cable 96, which in turn pulls on pin 90 to rotate spool 82 in a clockwise motion, as shown in FIG. 4.

Cable 96 is preferably steel cable and the blade is cutlery steel and handle can be a molded plastic, wood, metal or other materials.

Figure 5:
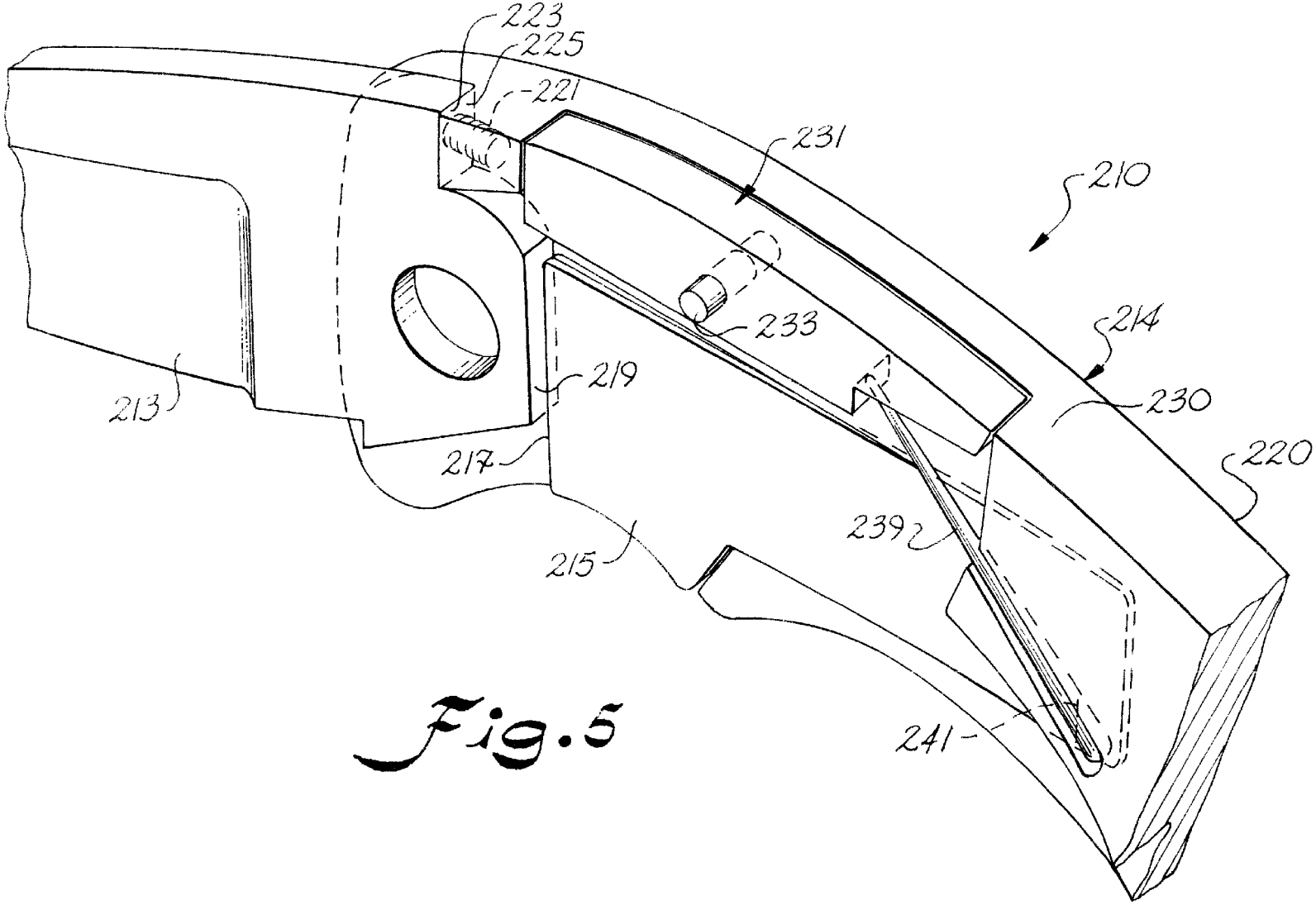
FIG. 5 is a partial perspective view of an alternate embodiment of a knife constructed in accordance with the present invention, wherein the blade is illustrated in an extended position.
Figure 6:
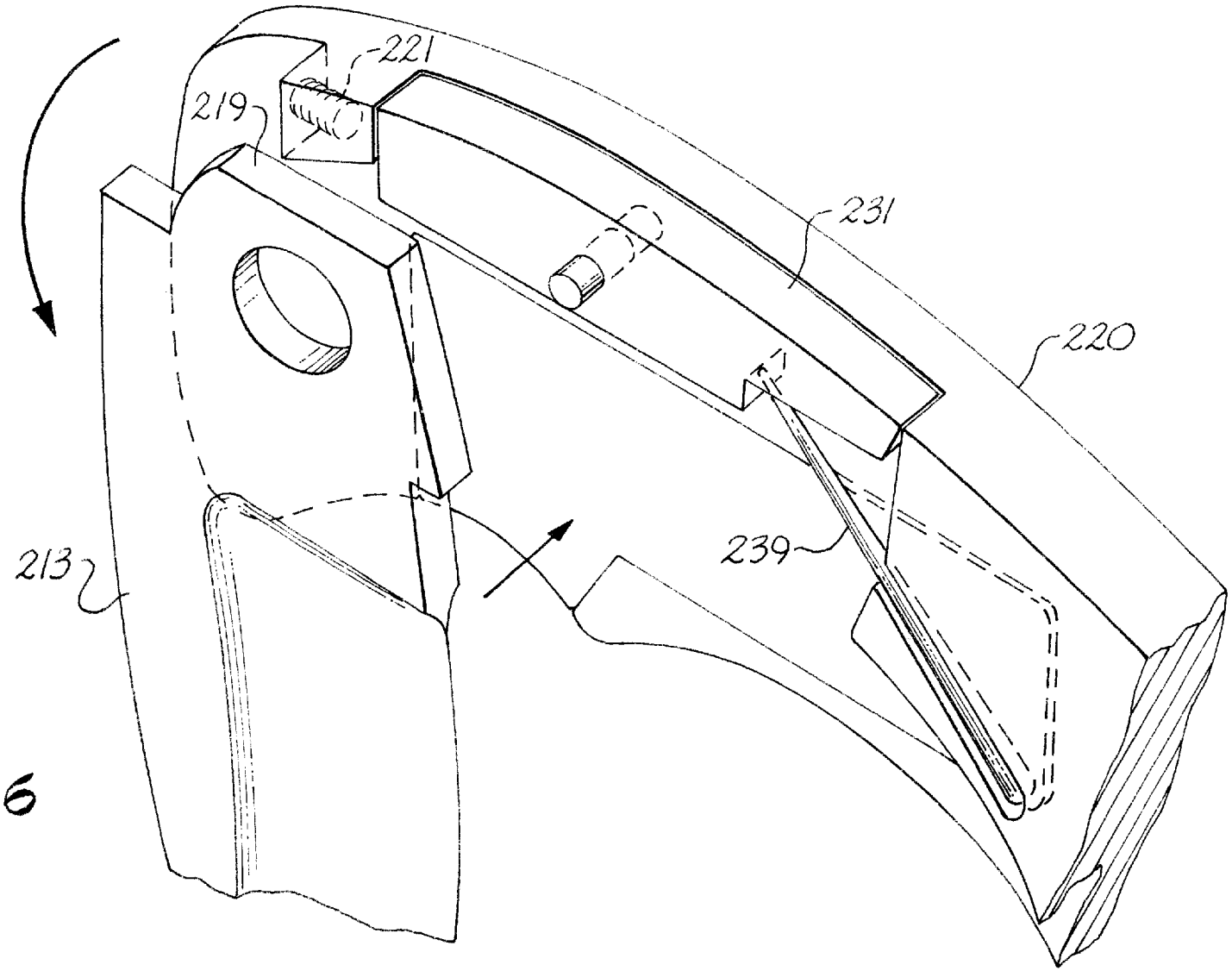
FIG. 6 is partial perspective view of the knife illustrated in FIG. 5, wherein the blade is in an intermediate position between the extended and retracted positions.

FIG. 5 illustrates an alternate embodiment folding knife 210 which preferably utilizes the same coil spring 98, cable 96, and the spool 82 mechanism discussed above, and illustrated in FIG. 8. However, folding knife 210 could also be a folding knife wherein the blade is opened manually and the spring, cable, spool combination eliminated.

Blade 213 of knife 210 is shown in FIG. 5 in its extended position and is automatically locked in that position through use of a spring-biased liner lock member, generally 215, which can be of conventional construction. Liner lock 215 includes a forward end 217 which engages with a rear flat edge 219 of blade 213 to thereby block blade 213 from pivoting rearwardly towards handle 214. Any "slop" or "play" between blade 213 and handle 214 can be eliminated through use of adjustment screw 221 which is threadingly carried in the handle stop portion 223. Blade 213 includes a blade stop flat 225 which may bear against adjustment screw 221. Adjustment screw 221 is thus useful during initial manufacture of knife 210 to ensure blade 213 has little or no play when opened, and also, as knife 210 wears, adjustment screw 221 can be turned outwardly to eliminate any play which develops during wear.

To move blade 213 to the retracted position, liner lock 215 is depressed inwardly, towards right handle side portion 220, such that edge 217 of liner lock 215 clears edge 219 of blade 213.

Figure 7:
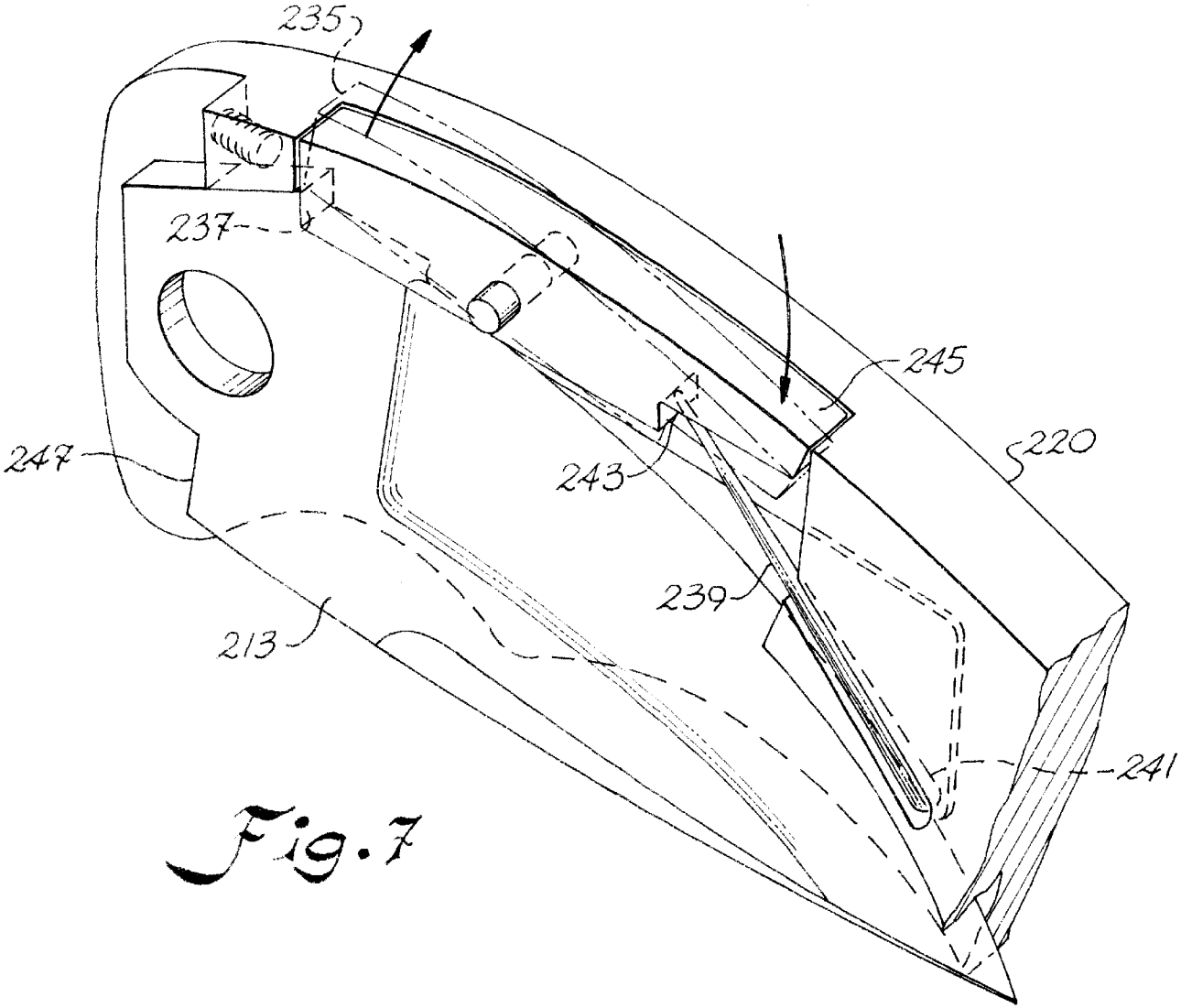
FIG. 7 is a partial perspective view of the knife illustrated in FIG. 5, wherein the blade is illustrated in a retracted position.

FIG. 7 illustrates blade 213 in its retracted position. Blade 213 is held within the retracted position through use of a release member, generally 231. Release member 231 extends along the back portion, generally 230, of handle 214, and preferably includes a lever 231 pivotally carried on an axle 233 fixedly connected to handle side portion 220. Lever 231 includes a retention flat 235 which engages with a corresponding blade flat 237 defined on blade 213. Retention lever 231, and thus retention flat 235, is urged towards blade flat 237 by means of a wire spring 239. One end of wire spring 239 is fixedly attached to handle 214 by means of the insertion thereof into a cavity 241. The free end of wire spring 239 contacts and urges upwardly the underside profile 243 of lever 231. Thus, in order to release blade 213 from its retracted position, and for blade 213 to automatically move to its extended position, and assuming use of the coil spring, cable, spool, in combination discussed above, the rear portion 245 of lever 231 is depressed sufficiently for retention flat 235 of lever 231 to clear upstanding blade flat 237. The abutment of blade stop 247 and lever end 235 prevent blade 213 from extending beyond the blade's extended position.

Figure 8:
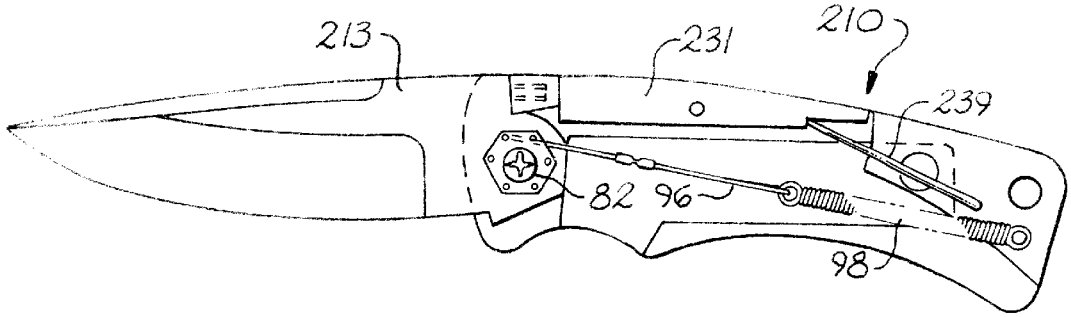
FIG. 8 is a side elevational view, with parts cut away, of the knife illustrated in FIG. 5.

FIG. 8 illustrates coil spring 98, cable 96, and spool 82 in use with knife 210.

An important feature of the folding knives 10, 210 of the present invention is the assembly of the coil spring 98, cable 96, and spool 82 combination. Providing proper spring tension in this combination is essential for creating a smooth automatic opening of the blade. However, due to variations in manufacturing, spring tension, the characteristics of individual cables 96, and overall build-up in manufacturing tolerances, some adjustment feature may be necessary. The plurality of openings 88 in spool 82 allow for such adjustment to be made. In order to provide proper tension, one of several opening pairs 88 defined in upper and lower flanges 84, 86 of spool 82 can be selected for insertion of pin 90, thereby allowing variations in the manufacture of components to be compensated for to yield uniformly operating knives on a production line basis.

Another important feature of assembling knives 10, 210 is the clip 44 and connector 28 arrangement. Because the drive profile 50 of connector 28 and the cooperating profile 52 on clip 44, projection 42 of clip 44 may be inserted into passage 40 of connector 28 during assembly, properly aligned with the handle, and held in place while a conventional driver (not shown) such as an Allen wrench, is used to drive the other of the male or female portion 30, 32, as the case may be, to tighten connector 28 together. This again allows for variances in components during manufacture and allows for the clip to always be properly aligned while the sides 18, 20 are fastened together, or while a side (not shown) of knife 210 and right side 220 are fastened together.

From the foregoing it can be seen that the knife designs of the present invention offer unique features in assembly techniques.

While preferred embodiments of the invention have been described using specific terms, such description is for present illustrative purposes only, and it is to be understood that changes and variations to such embodiments, including but not limited to the substitution of equivalent features or parts, and the reversal of various features thereof, may be practiced by those of ordinary skill in the art without departing from the spirit or scope of the following claims.

What is claimed is:

1. A folding knife comprising:

a handle;

a blade pivotally connected to said handle for movement between an extended position extending outwardly from said handle and a retracted position adjacent said handle;

a spool connected to said blade for movement with said blade, said spool defining a plurality of attachment openings; and a spring connected to at least one of said attachment openings of said spool and to said handle, said spring urging said blade towards said extended position.

2. A folding knife as defined in claim 1, wherein said plurality of attachment openings are radially spaced from one another.

3. A folding knife as defined in claim 1, wherein said spool includes a six-sided drive profile.

4. A folding knife as defined in claim 1, wherein said spool includes a drive profile.

5. A folding knife as defined in claim 1, wherein said handle defines a blade cavity for receipt of said blade when said blade is in said retracted position.

6. A folding knife as defined in claim 1, wherein said spool is fixedly attached to said blade.

7. A folding knife as defined in claim 1, further comprising an elongated member connected between said spring and said spool.

8. A folding knife as defined in claim 1, wherein said handle includes a first portion and a second portion and further comprising a connector extending through said first and second handle portions, said connector defining an opening therethrough having a drive profile.

9. A folding knife as defined in claim 8, further comprising a clip connected to said handle, said clip having an engagement portion for receipt in said opening of said connector, and said engagement portion defining a cooperating profile for cooperating with said drive profile of said connector.

10. A folding knife as defined in claim 9, wherein said drive profile of said opening of said connector and said cooperating profile of said engagement portion are hexagonal in cross-section.

11. A folding knife as defined in claim 1, further comprising a release member connected to said handle for selectively allowing movement of said blade from said retracted position under the urging of said spring.

12. A folding knife as defined in claim 1, further comprising a push button member connected to said handle for selectively allowing movement of said blade from said retracted position under the urging of said spring.

13. A folding knife as defined in claim 1, wherein said handle includes a first side portion, a second side portion, a blade opening between said first and second side portions, and a back portion opposite said blade opening, and further comprising a release member connected to said back portion of said handle for selectively allowing movement of said blade from said retracted position under the urging of said spring.

14. A folding knife as defined in claim 13, wherein said blade defines a retention profile and wherein said release member contacts said retention profile to retain said blade in said retracted position.

15. A folding knife as defined in claim 1, wherein said handle includes a first side portion, a second side portion, a blade opening between said first and second side portions, and a back portion opposite said blade opening, and further comprising a release lever connected to said back portion of said handle for selectively allowing movement of said blade from said retracted position under the urging of said spring.

16. A folding knife as defined in claim 1, wherein said handle includes a first side portion, a second side portion, a blade opening between said first and second side portions, and a back portion opposite said blade opening, and further comprising a release lever pivotally connected to said back portion of said handle for selectively allowing movement of said blade from said retracted position under the urging of said spring.

17. A folding knife comprising:

a handle;

a blade pivotally connected to said handle for movement between an extended position extending outwardly from said handle and a retracted position adjacent said handle;

a spool connected to said blade for movement with said blade, said spool defining a plurality of attachment openings; and a spring linked to at least one of said attachment openings of said spool and to said handle, said spring urging said blade towards said extended position.

18. A folding knife comprising:

a handle;

a blade pivotally connected to said handle for movement between an extended position extending outwardly from said handle and a retracted position adjacent said handle;

a spool connected to said blade for movement with said blade, said spool defining a plurality of attachment openings; and means for connecting a spring to at least one of said attachment openings of said spool and to said handle, said spring urging said blade towards said extended position.

* * * * *